US011976372B2

(12) United States Patent
Aki et al.

(10) Patent No.: US 11,976,372 B2
(45) Date of Patent: May 7, 2024

(54) PRODUCTION OF ADIPONITRILE

(71) Applicant: INV NYLON CHEMICALS AMERICAS, LLC, Wilmington, DE (US)

(72) Inventors: Sudhir N. V. K. Aki, Katy, TX (US); Benjamin D. Herzog, Wichita, KS (US); Milind V. Kantak, Wilmington, DE (US); Gregory S. Kirby, Avondale, PA (US); William J. Tenn, III, Beaumont, TX (US)

(73) Assignee: INV NYLON CHEMICALS AMERICAS, LLC, Wilmington, DE (US)

( * ) Notice: Subject to any disclaimer, the term of this patent is extended or adjusted under 35 U.S.C. 154(b) by 9 days.

(21) Appl. No.: 17/789,797

(22) PCT Filed: Feb. 25, 2021

(86) PCT No.: PCT/IB2021/051575

§ 371 (c)(1),
(2) Date: Jun. 29, 2022

(87) PCT Pub. No.: WO2021/176307

PCT Pub. Date: Sep. 10, 2021

(65) Prior Publication Data

US 2023/0053970 A1 Feb. 23, 2023

Related U.S. Application Data

(60) Provisional application No. 62/984,786, filed on Mar. 3, 2020.

(51) Int. Cl.
*C25B 3/09* (2021.01)
*C25B 3/25* (2021.01)
(Continued)

(52) U.S. Cl.
CPC ..... *C25B 3/09* (2021.01); *C25B 3/295* (2021.01); *C25B 9/13* (2021.01); *C25B 11/032* (2021.01);
(Continued)

(58) Field of Classification Search
CPC .. C25B 3/09; C25B 3/25; C25B 3/295; C25B 3/29
(Continued)

(56) References Cited

U.S. PATENT DOCUMENTS 3,488,267 A * 1/1970 Sloan ..... C07C 255/00 205/417
3,684,667 A 8/1972 Sayce
(Continued)

FOREIGN PATENT DOCUMENTS

CN 102002726 A * 4/2011 ..... C25B 3/00
CN 110016690 A * 7/2019 ..... C25B 15/00
CN 110016690 A 7/2019

OTHER PUBLICATIONS

International Search Report and Written Opinion received for PCT Application No. PCT/IB2021/051575, dated May 11, 2021, 10 Pages.

*Primary Examiner* — Edna Wong

(57) ABSTRACT

Disclosed is a process for preparing adiponitrile from acrylonitrile in an electrolytic cell. An aqueous electrolyte comprising acrylonitrile converts to adiponitrile in the presence of a solid anode and in the absence of a solid cathode. The cathode comprises gas plasma.

20 Claims, 1 Drawing Sheet

(51) Int. Cl.

| | |
|---|---|
| ***C25B 3/29*** | (2021.01) |
| ***C25B 9/13*** | (2021.01) |
| ***C25B 11/032*** | (2021.01) |
| ***C25B 11/046*** | (2021.01) |
| ***C25B 15/08*** | (2006.01) |

(52) U.S. Cl.
CPC ..... *C25B 11/046* (2021.01); *C25B 15/083* (2021.01); *C25B 15/087* (2021.01)

(58) Field of Classification Search
USPC ..... 205/417
See application file for complete search history.

(56) References Cited

U.S. PATENT DOCUMENTS

| | | | | |
|---|---|---|---|---|
| 4,306,949 | A | 12/1981 | Campbell et al. | |
| 8,529,749 | B2 | 9/2013 | Sankaran | |
| 2011/0048960 | A1* | 3/2011 | Sankaran ..... | B82Y 30/00 205/560 |
| 2019/0292063 | A1 | 9/2019 | Renner et al. | |

* cited by examiner

PRODUCTION OF ADIPONITRILE

RELATED APPLICATIONS

This application is a national phase of PCT/IB2021/051575, filed Feb. 25, 2021, which claims the benefit of U.S. Provisional Application No. 62/984,786, filed on Mar. 3, 2020, which are incorporated herein by reference in their entireties.

FIELD

The present application relates to the production adiponitrile from acrylonitrile.

BACKGROUND

Adiponitrile (ADN) is an important intermediate in the production of hexamethylenediamine (HMDA), which is one of the monomers used in the production of nylon-6,6; a copolymer of HMDA and adipic acid (AA). Historically, nylon-6,6 was used primarily to form carpet fibers used in high quality rugs for residential applications and in fibers for clothing. More recently, nylon-6,6 has been used as an engineering resin in demanding high-temperature automotive 'under the hood' applications such as linings for hydraulic brake lines, cable and wire insulation, and molded parts such as radiator housings.

One route for producing adiponitrile, which has been commercially practiced for over 50 years, involves the electro-hydrodimerization of acrylonitrile. An early example of such a process is disclosed in U.S. Pat. No. 4,306,949, in which an aqueous electrolyte containing at least 0.1% by weight of acrylonitrile, at least $10^{-5}$ gram mol per liter of quaternary ammonium cations of a directive salt and at least 0.1% by weight of a conductive salt is electrolyzed in an undivided reaction cell. The aqueous electrolyte is in contact with a cathodic surface having a cathode potential sufficient for hydrodimerization of the acrylonitrile with incidental formation of oxygen at the anodic surface. During electrolysis an effective amount of a non-competing gas, such as nitrogen, helium, hydrogen, argon, and/or air, is charged to the electrolyte so as to lower the concentration of oxygen in the aqueous electrolyte and at the cathodic surface and thereby diminish corrosion of the cathodic surface. Typically, the cathodic surface is cadmium and the anodic surface is steel.

A more recent iteration of the electro-hydrodimerization of acrylonitrile to produce adiponitrile is disclosed in CN110016690A. Features include placing an electrolyte comprising acrylonitrile in an undivided cell, one side of which is connected with plasma gas; carrying out electrolysis while introducing the plasma gas into the electrolyte; passing the electrolyzed liquid through a three-phase separator to separate out the oil phase; and distilling the oil phase to yield an adiponitrile product. Since the plasma gas has absorbed high-frequency energy and very high electrical conductivity, it is effective not only in effecting the required mass transfer of the adiponitrile product from the cathode surface but also in increasing the electrolysis efficiency which can reduce the current density of the electrolyte and thereby lower the energy consumption needed for electrolysis. A suitable plasma gas is argon; an anode material is stainless steel or an insoluble titanium-based electrode, and a cathode material is cadmium or lead.

U.S. Pat. No. 8,529,749B2 relates to an electrochemical cell that employs a plasma source. A method of operating an electrochemical cell is also disclosed.

Problems with certain technologies arise from organic base and hydrogen formation. Cathodes can be contaminated with iron. Cathodes can lose cadmium from corrosion. Organic bases constitute yield losses, and must be separated from the adiponitrile product to maintain high product quality. Hydrogen formation can result in explosive off-gas mixtures containing both hydrogen and oxygen to be present in the process, which presents a significant hazard. These issues are well described in "Electro-organic Synthesis and Product Recovery: An illustration using the EHD of acrylonitrile" by Chris J. H. King and Charles E. Cutchens, Solutia, Inc., $11^{th}$ International Forum, Electrolysis in the Chemical Industry, Nov. 2-6, 1997. It would be highly desirable to solve the problems.

Despite recent advances, there remains considerable interest in developing improved processes for the electro-hydrodimerization of acrylonitrile to produce adiponitrile and in particular to reduce or obviate the need for periodic shutdowns to replace the metallic anode and/or cathode.

SUMMARY

Disclosed is a process for converting acrylonitrile to adiponitrile in a cell with a plasma-forming gas in the absence of a metal cathode. The process simplifies maintenance and reduces corrosion products. Reducing corrosion products can be especially beneficial if the corrosion products are catalytically active for converting adiponitrile to undesired side products.

Disclosed is a process for converting acrylonitrile to adiponitrile comprising:

a. flowing aqueous electrolyte comprising acrylonitrile to a cell having an anode in the absence of a solid cathode;
b. flowing gas plasma cathode to the cell, wherein the gas plasma cathode is separated from the anode by the electrolyte; and
c. recovering product containing adiponitrile from the cell.

The aqueous electrolyte can comprise at least one selected from the group consisting of:

a. ≥21 wt % to ≤58 wt % acrylonitrile;
b. ≥24 wt % to ≤521 wt % phosphate;
c. ≥20.2 wt % to ≤8 wt % EDTA; and
d. ≥20.1 wt % to ≤8 wt % quaternary amine salt.

The aqueous electrolyte can comprise at least two selected from the immediately preceding group.

The pH of the electrolyte can be ≥6 and ≤9, for example, ≥6 and ≤8, ≥6.5 and ≤7.5.

EDTA can suitably be present in the electrolyte as a sodium or potassium salt of EDTA.

If the electrolyte contains phosphate, the phosphate can comprise one or several of sodium phosphate, sodium hydrogen phosphate, sodium dihydrogen phosphate, potassium phosphate, potassium hydrogen phosphate, and potassium dihydrogen phosphate.

The skilled person can adjust process conditions to achieve a range of desired per-pass conversions, selectivities and yields. Examples of suitable process conditions include an electrolyte temperature of ≥20° C. to ≤50° C., a current density of ≥300 Amps/$m^2$ to ≤2000 Amps/$m^2$, and an electrolysis voltage of ≥3 to ≤6 Volts.

Suitable plasma gases include gases that are inert to the conversion of acrylonitrile to adiponitrile, for example, argon.

The plasma gas can be generated outside the cell, for example, in an external plasma generator.

The plasma gas can transfer to the cell by vacuum.

The supply rate of plasma gas to the electrolytic cell can be adjusted to obtain a desired conversion, selectivity and yield, for example, from ≥0.2 to ≤2 liters/hr per liter of electrolyte.

The anode of the cell comprises at least one of:

a. stainless steel;

b. carbon steel; and c. a titanium-containing alloy.

The cell can optionally be free of a solid anode.

The anode can comprise a gas, for example, hydrogen.

The cell can be an undivided cell.

The process can further comprise:

a. recovering electrolyzed liquid from the cell; and b. separating an adiponitrile-containing organic phase from the recovered electrolyzed liquid.

The process can still further comprise:

a. separating an aqueous phase from the recovered electrolyzed liquid; and b. recycling at least part of the aqueous phase as electrolyte provided to the cell.

DETAILED DESCRIPTION

Figure 1:
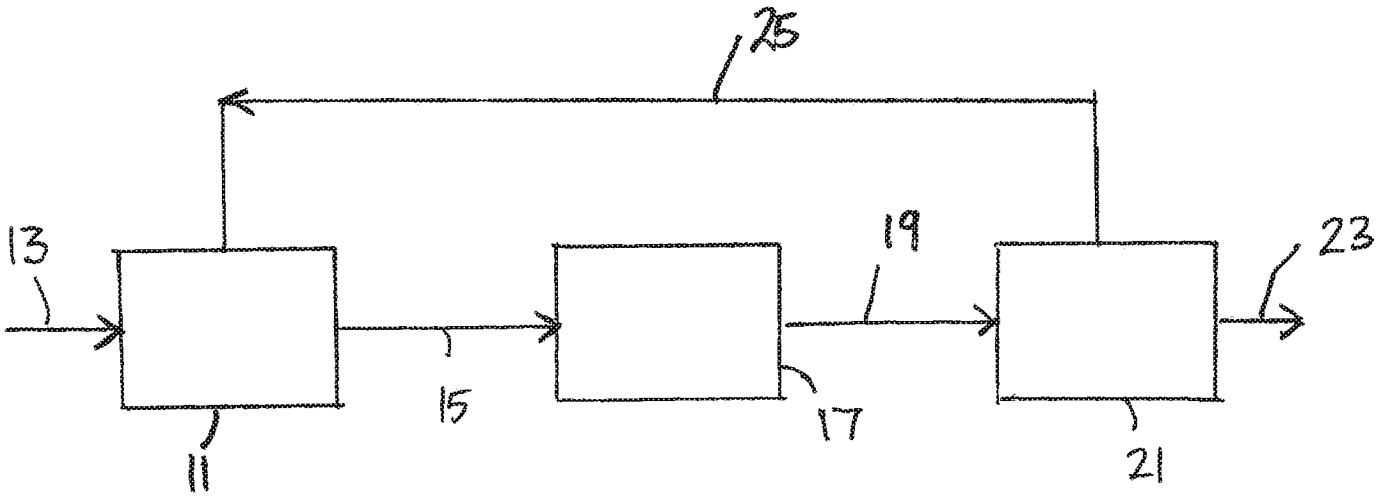
FIG. 1 is a simplified schematic representation of a process according to one embodiment of the present disclosure for preparing adiponitrile from acrylonitrile.

The present disclosure provides a process and apparatus for preparing adiponitrile by from acrylonitrile. While not to limit the scope of the invention by a recitation of theory, the following overview can be useful for the skilled person to efficiently select process conditions for the disclosed process.

The reaction mechanism of this process has been studied in detail. While the theoretical mechanism is not fully understood, it is believed that in the first stage of the process, protonation of acrylonitrile [$CH_2{=}CHCN$] to cyanoethyl anion [$CH_2CH_2CN^-$] occurs by binding with the two electrons [$e^-$] and one proton [$H^+$] as follows: $CH_2{=}CHCN+H^++2e^-\rightarrow CH_2CH_2CN^-$.

In the second stage, it is believed that the resulting cyanoethyl anion interacts with a second acrylonitrile molecule as follows: $CH_2{=}CHCN+CH_2CH_2CN^-\rightarrow NCCH(CH_2)_3CN^-$.

The resultant dimeric anion then reacts with a hydrogen ion to generate adiponitrile: $NCCH(CH_2)_3CN^-+H^+\rightarrow NC(CH_2)_4CN$.

During the above-mentioned electrolytic reaction, an electro-oxidation reaction takes place at the anode (i.e., the positively charged electrode) surface that is surrounded by the aqueous cell medium. This anodic electro-oxidation provides free electrons and protons for the electro-chemistry described above. Specifically, the protons [$H^+$] and free electrons [$e^-$] are made available by the anodic water electrolysis reaction as follows:

$$2H_2O\rightarrow O_2+4H^++4e^-$$

In a continuous electrochemical dimerization process conducted in an undivided electrolytic cell it has now been discovered that the protons then migrate across the electro-conductive medium and find the ionically charged gas-liquid interface which serves as the cathode (or the negatively charged electrode) where the above protonation and dimerization reactions occur. The charged gas-liquid interface is present due to the introduction of ionized plasma gas phase in the cell. At this interface the alkene feed molecules [acrylonitrile, for example] are protonated and further dimerized to form adiponitrile. The electro-conductive medium facilitates the continuous flow of the protons and free electrons across the cell.

The hydrodimerization reaction continues, as shown above, whereby two molecules of protonated acrylonitrile further convert to adiponitrile [$NC(CH_2)_4CN$]. Other side electrochemical reactions may occur at the charged gas-liquid interface thereby forming byproducts; propionitrile [$CH_3CH_2CN$], acrylonitrile hydrotrimer [$NC(CH_2)_3NCCH(CH_2)_3CN$].

One possible mechanism for the disclosed process includes the following overall schematic reactions at the dispersed ionized gas-liquid interface:

$$2CH_2{=}CH{-}CN+2H_2O+2e^-\rightarrow NC{-}(CH_2)_4{-}CN+2OH^-;$$

$$CH_2{=}CH{-}CN+2H_2O+2e^-\rightarrow CH_3CH_2CN+2OH^-;$$

and $$3CH_2{=}CH{-}CN+2H_2O+2e^-\rightarrow NC(CH_2)_3NCCH(CH_2)_3CN+2OH^-.$$

In the present process and apparatus, the electrolysis is conducted in a cell containing an aqueous electrolyte comprising acrylonitrile and having an anode and a cathode separated by the electrolyte. However, unlike prior processes, in the cell employed in the present process, the conventional metal cathode surface is replaced by a gas plasma supplied to the electrolyte to provide the cathode during electrolysis. The anode of the cell employed in the disclosed process can be metallic, for example stainless steel, carbon steel or titanium alloy such as an insoluble titanium-based alloy. The cell may be a single undivided cell or may be a divided cell in which the ionized plasma gas [serving as a cathode] and anode are kept in different chambers, separated by an ion-permeable membrane or salt bridge.

In a conventional electrolytic cell, maintenance of high electrolytic conductivity, i.e., efficient current passage between the two electrodes while having high current densities across the electrodes, is very important. Traditionally, an aqueous electrolytic medium containing organic or inorganic salts are used, for example, a mixture of quaternary ammonium and alkali metal salts together with the alkene feed that is to be hydrodimerized. Such electrolytic cell systems contain a pair of electrodes (cathode and anode) for the desired electrolytic activity to complete.

However, in such systems, the electrolytic conductivity is difficult to maintain due to the various factors, such as multi-phasic medium, flow restrictions due to the cell sizes, operating conditions, build-up of contaminants, electrodes and their surface characteristics, etc.

It is unexpectedly found that when a gas plasma is introduced to the cell medium as a highly dispersed ionized gas phase replacing the cathode, the overall electrolytic conductivity improves. It is known that cathode corrosion is common in such systems and the resulting resistance to current flow and current densities reduces the overall performance.

The disclosed process eliminates the metal surface cathode. Further, the ionized gas phase (plasma) can be well-dispersed in the electrolyte cell medium for the uniform, localized electro-chemistry to occur at this dispersed ionized gas-liquid interface. In previously known processes that used a metal cathode, the reactants mass transfer occurred from the bulk medium to the active charged surface; and was balanced by the products mass transfer from the active charged surface back to the bulk. The disclosed process can improve overall mass transfer of the reactant and product species. The disclosed electrolytic cell can improve current efficiency while improving reactant conversion and product yield.

The electrolyte employed in the present process contains acrylonitrile, which is typically present in the aqueous base of the electrolyte in an amount from ≥1 wt. % to ≤8 wt. % of the total electrolyte, with the upper limit of around about ≤8 wt. % largely being governed by the solubility of acrylonitrile in water that is part of the electro-conductive medium.

In some embodiments, the electrolyte employed herein may also comprise one or more phosphate salts, typically in an amount from ≥4 wt. % to ≤21 wt. % of the total electrolyte. Suitable phosphate salts include one or several of sodium phosphate, sodium hydrogen phosphate, sodium dihydrogen phosphate, potassium phosphate, potassium hydrogen phosphate, and potassium dihydrogen phosphate.

In some embodiments, the electrolyte employed herein may also comprise ethylenediaminetetraacetic acid (EDTA) or a salt thereof, typically present in an amount from ≥0.2 wt. % to ≤8 wt. % of the total electrolyte. Suitable EDTA salts comprise the sodium and potassium salts and mixtures thereof.

In some embodiments, the electrolyte employed herein may also comprise one or more quaternary ammonium or phosphonium salts, typically present in an amount from ≥0.1 wt. % to ≤8 wt. % of the total electrolyte. Suitable salts can include those that contain only one pentavalent nitrogen or phosphorous atom as in, for example, various monovalent mono-quaternary ammonium (e.g. tetraalkylammonium) or mono-quaternary phosphonium (e.g. tetraalkylphosphonium) cations, but they may contain more than one of such pentavalent atoms as in, for example, various multivalent multiquaternary ammonium or phosphonium cations such as the bisquaternary ammonium or phosphonium cations, e.g. polymethylenebis (trialkylammonium or trialkylphosphonium) cations. Mixtures of such monovalent and multivalent quaternary ammonium and/or phosphonium cations can also be used. Suitable monoquaternary ammonium or phosphonium cations may be cyclic, as in the case of the piperidinium, pyrrolidinium and morpholinium cations, but they are more generally of the type in which a pentavalent nitrogen or phosphorous atom is directly linked to a total of four monovalent organic groups preferably devoid of olefinic unsaturation and desirably selected from the group consisting of alkyl and aryl radicals and combinations thereof. Suitable multiquaternary ammonium or phosphonium cations may likewise by cyclic, as in the case of the piperazinium cations, and they are typically of a type in which the pentavalent nitrogen or phosphorous atoms are linked to one another by at least one divalent organic (e.g. polymethylene) radical and each further substituted by monovalent organic groups of the kind just mentioned sufficient in number (normally two or three) that four fifths of the valence of each such pentavalent atom is satisfied by such divalent and monovalent organic radicals. As such monovalent organic radicals, suitable aryl groups contain typically from six to twelve carbon atoms and preferably only one aromatic ring as in, for example, a phenyl or benzyl radical, and suitable alkyl groups can be straight-chain, branched or cyclic with each typically containing from one to twelve carbon atoms.

Although quaternary ammonium or phosphonium cations containing a combination of such alkyl and aryl groups (e.g. benzyltriethylammonium or phosphonium ions) can be used, many embodiments of the present process are preferably carried out with quaternary cations having no olefinic or aromatic unsaturation. Good results are generally obtained with tetraalkylammonium or tetraalkylphosphonium ions containing at least three $C_2$ to $C_6$ alkyl groups and a total of from 8 to 24 carbon atoms in the four alkyl groups, e.g. tetraethyl-, ethyltripropyl-, ethyltributyl-, ethyltriamyl-, ethyltrihexyl-, octytriethyl-, tetrapropyl-, methyltripropyl-, decyltripropyl-, methyltributyl-, tetrabutyl-, amyltributyl-, tetraamyl-, tetrahexyl-, ethyltrihexyl-, diethyldioctylammonium or -phosphonium cations. Generally most practical from the economic standpoint are those tetraalkylammonium ions in which each alkyl group contains from two to five carbon atoms, e.g. diethyldiamyl-, tetrapropyl-, tetrabutyl-, and amyltripropyl-, tetraamylammonium, and those $C_8$ to $C_{20}$ tetraalkylphosphonium ions containing at least three $C_2$ to $C_5$ alkyl groups, e.g. methyltributyl-, tetrapropyl-, ethyltriamyl-, and octyltriethylphosphonium. Similarly good results are obtained by use of the divalent polymethylenebis(trialkylammonium or trialkylphosphonium) ions, particularly those containing a total of from 17 to 36 carbon atoms and in which each trialkylammonium or trialkylphosphonium radical contains at least two $C_3$ to $C_6$ alkyl groups and the polymethylene radical is $C_3$ to $C_8$, i.e., a straight chain of from three of eight methylene radicals. Any of such cations can be incorporated into the aqueous solution to be electrolyzed in any convenient manner, e.g. by dissolving the hydroxide or a salt (e.g. a $C_1$-$C_2$ alkylsulfate) of the desired quaternary ammonium or phosphonium cation(s) in the electrolyte in the amount required to provide the desired concentration of such cations.

Typically, the pH of the electrolyte is from ≥6 and ≤9. The cell medium pH control is critical from the point of minimizing unwanted acid- and base-catalyzed by-product reactions via cyanoethylation, hydrolysis, reductive hydrogenation, and combinations thereof. Conventional ways of pH control may be practiced, which include pre-determined addition of pH adjusting agents, buffers, etc. Such approaches are well-known in the industry and, it will be understood that such pH control additives remain inert towards the electrochemistry employed herein.

In some embodiments the gaseous feed used for plasma gas generation is argon. Thus, not only is argon readily available but also, being an inert gas, argon does not participate in the electro-chemical reactions in any shape or form. Other non-limiting examples of suitable gas for plasma feed are neon, helium, carbon dioxide, krypton, xenon, etc. The selection of the plasma gas may depend on the techno-economic analysis, i.e., gas availability, ease of handling and overall cell performance.

The plasma gas is suitably transferred to the electrolytic cell by vacuum, for example, by vacuum pump. Atmospheric transfer may likewise be suitable. Transfer of the plasma gas to the cell under pressure can also be accomplished, for example, by use of a compressor system.

The plasma gas is suitably recycled by removal of a portion of the gas from the electrolytic cell, removal of gaseous purges or vent streams from the gas recycle stream, and return of a portion of the gas to the plasma generator. The vent streams can in some cases allow for removal of a portion of by-products from the system.

The plasma gas may be prepared by means of a plasma generator. One end of the plasma generator communicates with a reasonably dry gas supply unit, such as an argon supply unit. In a specific application, the main constituent part of the gas supply unit is a vacuum pump, which can introduce argon gas stored in an external storage tank into the plasma generator to generate an argon gas stream. The plasma generator comprises a high-voltage power supply, a high-voltage electrode, and a discharge chamber. The high-voltage power supply is electrically connected to the high-voltage electrode. One end of the discharge chamber is provided with a gas inlet connected to the gas supply unit, and the other end of the discharge chamber is a gas outlet in communication with the electrolyte. The high-voltage electrode is placed in the discharge chamber, and the high-voltage power supply can stimulate ionization of argon gas at the high-voltage electrode into plasma gas. In a specific application, the high-voltage power supply is a high voltage pulse generator generating pulses at a frequency not higher than 100 kHz. The higher the frequency of the high voltage pulse generator, the quicker the processing speed of the plasma. The discharge chamber can be made from insulating materials such as glass and ceramics. The high-voltage electrode undergoes high voltage discharge in the gas passages of the discharge chamber to generate plasma gas. Argon gas in an external gas storage tank is constantly introduced into the discharge chamber under the action of a vacuum pump, which, following the completion of high voltage ionization in the discharge chamber, drives the introduction of the plasma gas into the electrolyte to make contact therewith.

In some embodiments, the strength of the plasma gas flow employed for electrolysis of 1 liter of electrolyte solution is from about 0.2 to 2 Liters/hr.

In some embodiments, the conditions for the electrolysis step of the present process are an electrolysis temperature of ≥20° C. to ≤50° C., a current density of ≥300 amps/$m^2$ to ≤2000 amps/$m^2$, and an electrolysis voltage of ≥3 to ≤6 Volts.

The electrolysis may be conducted for the theoretical electrolysis time required to complete the reaction, depending on the conditions employed, after which the electrolysis product is supplied to a separator effective to at least separate the electrolysis product into an adiponitrile-containing organic phase and an aqueous phase. Contact times can include ≥1 minute to ≤10 hours, for example, ≥5 minutes to ≤5 hours, for example, ≥5 minutes to ≤1 hour. The organic phase can then be supplied to a distillative separation train where any unreacted acrylonitrile as well as by-products, mainly, propionitrile, di- and trimer polymers of acrylonitrile may be separated from the desired adiponitrile product. The aqueous phase may be recycled back to cell as part of electrolyte, preferably after purification to remove contaminants, such as metal species, residual organics, etc. A conventional approach of taking a suitable purge stream to maintain and control the buildup of these contaminants is well-known in the industry. A fresh make-up for the lost electrolytic medium via purge may be fed to balance the process. The contaminants purge stream is typically disposed using proper waste handling methods.

Referring now to the drawing, in the process of FIG. 1 the components of an electrolyte for the electro-hydrodimerization of acrylonitrile to adiponitrile are added to a mixing tank 11 via one or more supply lines shown generically by the line 13. After mixing in the tank 11, the resultant electrolyte is fed via line 15 to an electrolytic cell 17 having a metal anode (not shown) and an argon gas plasma cathode (not shown). When electrolysis is complete, the electrolytic product is sent via line 19 to a separator 21, where the product is separated into an organic phase and an aqueous phase.

The separator 21 may contain a gas-liquid disengagement section for the separation of gaseous constituents present in line 19. Non-limiting examples of the gas constituents in line 19 may include the gas used as ionized plasma, oxygen generated from the anodic reaction, hydrogen from protonic activity, fugitive organics, and such. The disengaged gas line is not shown in FIG. 1.

The separator 21 may contain conventional one or more unit operations that effectively separate the organic phase from the aqueous phase. Such unit operations are well known to chemical engineers skilled in the art of product separations.

The organic phase is collected in line 23 and sent to a distillation train (not shown) for recovery of the adiponitrile product, while the aqueous phase is collected in line 25 and recycled to the mixing tank 11.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

Electrolytic Cell—Metal Cathode and Metal Anode

An electrolytic cell unit 17 (in FIG. 1) includes a vessel that contains the liquid electrolyte and reaction media, wherein two flat surfaces are immersed that serve as the two electrodes, cathode and anode. The cathode surface is made up of cadmium (Cd), while the anode surface is made up of stainless steel. The linear spacing between the two electrodes is in the 1.25-2.5 mm range and can be adjusted by moving the two electrodes closer to or further apart from each other. The cell contains an external electric power supply and the two electrodes are connected to complete the continuous electric current flow passageway.

The cell is operated at a current density in the 300-2000 amps/$m^2$ range. The cell operating pressure is in the range of 0-10 Psi (gauge). The cell operating temperature is in the range of 20-55° C. The cell contents are continuously circulated through the cell at a rate of about 3-6 ft/s or about 1-2 m/s. The feed line 15 (FIG. 1) to the cell unit 17 (FIG. 1) is about 1-10% organic phase and about 90-99% aqueous phase (% is by weight).

Electrolytic Cell—Metal Anode and Plasma Gas Cathode:

An electrolytic cell, similar to the one above and used in Comparative Examples, includes a vessel that contains the liquid electrolyte and reaction media, wherein one flat surface is immersed and serves as an anode. The anode surface is made up of stainless steel.

The cell is integrated with a gas plasma generation unit. A dry gas stream is fed to the plasma generation unit and a highly ionized gas plasma stream is made available to be fed to the cell. The highly ionized (or charged) gas plasma is introduced and dispersed in the electrolyte medium. This dispersed gas plasma phase acts as a second electrode and the current flows through the electrolyte and across the anode surface. This current activity through the electrolyte initiates the desired electrochemical reaction that consumes the organic feed material present in the electrolyte medium.

The cell is operated at a current density in the 300-2000 amps/$m^2$ range. The cell operating pressure is in the range of 0-10 Psi (gauge). The cell operating temperature is in the range of 20-55° C. The cell contents are continuously circulated through the cell at a rate of about 3-6 ft/s or about 1-2 m/s. The feed to the cell is about 1-10% organic phase and about 90-99% aqueous phase (% is by weight).

In the examples of this disclosure, the yield of adiponitrile is defined as Yield %=(moles of adiponitrile produced)/(moles of adiponitrile expected based on the amount of acrylonitrile fed)×100.

The term, "hydrodimerize" or "hydrodimerized" or "hydrodimerization", as used herein, means an organic reaction that couples two alkene molecules with concomitant addition of hydrogen to yield a symmetrical hydrocarbon, called a dimer. As an example, two molecules of acrylonitrile undergo hydrodimerization to form adiponitrile according to the below scheme:

$$2CH_2{=}CH{-}CN+2e^-+2H^+ \rightarrow NC{-}CH_2{-}CH_2{-}CH_2{-}CH_2{-}CN.$$

The term "electro-dimerization" or "electro-hydrodimerization" refers to carrying out the above dimerization process in an electrolytic cell.

EDTA is ethylenediamine tetra-acetic acid.

The chemical component analysis can be performed using a standard gas chromatograph (GC) or liquid chromatograph (LC) method.

In the gas plasma cathode examples below, the adiponitrile product is at least 99.0 wt. % purity with <1.0 wt. % total for succinonitrile, MGN, CPI, acrylonitrile, HOPN, MCPA, BCE, and other trace impurities.

MGN is 2-methylglutaronitrile.

CPI is 2-cyanocyclopentylideneimine.

HOPN is hydroxypropionitrile.

MCPA is mono-cyanopropylamine.

BCE is bis-(cyanoethyl)-ether.

EDTA is ethylenediaminetetraacetic acid.

EXAMPLES

Example 1

To a conventional undivided electrolytic cell of the type described above and in FIG. 1 is charged a feed stream 15 containing 1 wt. % acrylonitrile, and an aqueous electrolyte medium containing 4 wt. % sodium hydrogen phosphate, 0.2 wt. % ethylenediamine tetra-acetic acid (EDTA), 0.5 quaternary ammonium salt (hexamethylene bisethyldibutylammonium p-toluenesulfonate), and the balance is water. The cell is continuously circulated, maintained at a constant temperature of 25° C., and operated at a current density of 500 amps/$m^2$. The cell is operated using a carbon steel anode separated by 2 mm from a cadmium cathode. The solution is electrolyzed within the cell at an electrolysis voltage of 5 Volts. Following the electrolysis, the electrolyzed effluent stream 19 is carried to the separator 21. The organic phase 23 containing the adiponitrile product is further processed using distillative separation. The yield of adiponitrile is determined to be 84.4% by gas chromatographic analysis.

Example 2

Example 1 is repeated, except the cell is operated using a carbon steel anode separated by 2 mm from a cadmium cathode, and additionally an ionized argon gas plasma that is fed to the cell. Following the electrolysis and separation/refining, the yield of adiponitrile is determined to be 95.2%.

Example 3

Example 1 is repeated, except the electrolyte cell is operated using a carbon steel anode, and the cathode is replaced by an ionized argon gas plasma that is fed to the cell. The dispersed ionized argon gas phase in the electrolyte medium acts as the cathode. Following the electrolysis and separation/refining, the yield of adiponitrile is determined to be 95.7%.

Example 4

Example 1 is repeated, except the cell is operated using a carbon steel anode, and the cathode is replaced by an ionized neon gas plasma that is fed to the cell. The dispersed ionized neon gas phase in the electrolyte medium acts as the cathode. Following the electrolysis and separation/refining, the yield of adiponitrile is determined to be 94.1%.

Example 5

Example 1 is repeated, except the cell is operated using a carbon steel anode, and the cathode is replaced by an ionized carbon dioxide gas plasma that is fed to the cell. The dispersed ionized carbon dioxide gas phase in the electrolyte medium acts as the cathode. Following the electrolysis and separation/refining, the yield of adiponitrile is found to be 91.9%.

The examples presented illustrate the effectiveness of the use of gas plasma electrolysis for the electrochemical coupling of acrylonitrile to afford adiponitrile. The data show that plasma-based systems that eliminate the metal surface cathode display increased yields of adiponitrile product formation relative to a traditional system operated using two conventional electrodes. Comparison of Examples 2 and 3 demonstrate that both argon and neon are essentially equally effective as plasma source gases, and likewise, Example 4 illustrates that improved yields of adiponitrile can be obtained relative to those afforded by the conventional cell of Example 1 when carbon dioxide is used as the plasma gas.

The invention claimed is:

1. A process for converting acrylonitrile to adiponitrile comprising:

(a) flowing aqueous electrolyte comprising acrylonitrile to an electrolytic cell having an anode in the absence of a solid cathode;

(b) flowing gas plasma into the electrolyte in the electrolytic cell as a cathode of the electrolytic cell, wherein the gas plasma cathode is separated from the anode by the electrolyte;

(c) operating the electrolytic cell under conditions to convert at least part of the acrylonitrile in the electrolyte to adiponitrile, and (d) recovering product containing the adiponitrile from the electrolytic cell.

2. The process of claim 1, wherein the aqueous electrolyte further comprises at least one selected from the group consisting of:

a) ≥1 wt % to ≤8 wt % acrylonitrile;

b) ≥4 wt % to ≤21 wt % phosphate;

c) ≥0.2 wt % to ≤8 wt % EDTA; and d) ≥0.1 wt % to ≤8 wt % quaternary amine salt.

3. The process of claim 2 wherein the aqueous electrolyte comprises at least two selected from the group.

4. The process of claim 2, wherein the EDTA is present in the electrolyte as a sodium or potassium salt of EDTA.

5. The process of claim 2, wherein the phosphate comprises one or several of sodium phosphate, sodium hydrogen phosphate, sodium dihydrogen phosphate, potassium phosphate, potassium hydrogen phosphate, and potassium dihydrogen phosphate.

6. The process of claim 1 wherein the electrolyte has a pH of ≥6 and ≤9.

7. The process of claim 1, wherein the conditions include at least one of an electrolyte temperature of ≥20° C. to ≤50° C., a current density of ≥300 amps/$m^2$ to ≤2000 amps/$m^2$, and an electrolysis voltage of ≥3 to ≤6 volts.

8. The process of claim 1, wherein the gas plasma comprises argon.

9. The process of claim 1 further comprising producing the gas plasma in a plasma generator outside the electrolytic cell.

10. The process of claim 9 further comprising transferring the gas plasma to the electrolytic cell by vacuum.

11. The process of claim 9 further comprising transferring the gas plasma to the electrolytic cell at atmospheric pressure.

12. The process of claim 1 further comprising recycling a portion of the gas plasma for reuse in the process.

13. The process of claim 1, wherein the gas plasma is supplied to the electrolytic cell at a rate from 0.2 to 2 liters/hr per liter of electrolyte.

14. The process of claim 1, wherein the anode of the electrolytic cell comprises at least one of:

e) stainless steel;

f) carbon steel; and g) a titanium-containing alloy.

15. The process of claim 1, wherein the cell is free of a solid anode.

16. The process of claim 15 wherein the anode comprises a gas.

17. The process of claim 16 wherein the gas comprises hydrogen.

18. The process of claim 1, wherein the cell is an undivided cell.

19. The process of claim 1 further comprising separating an adiponitrile-containing organic phase from the product recovered from the electrolytic cell.

20. The process of claim 19 and further comprising:

(a) separating an aqueous phase from the product recovered from the electrolytic cell; and (b) recycling at least part of the aqueous phase as electrolyte flowed to the electrolytic cell.

* * * * *